US006089177A

United States Patent [19]

Müller

[11] Patent Number: 6,089,177

[45] Date of Patent: Jul. 18, 2000

[54] TRIM TAB AND VARIABLE-EXHAUST SYSTEM ESPECIALLY FOR MOTOR BOATS AND MOTOR YACHTS

[76] Inventor: Peter Müller, Isengrund 9, CH-8134 Adliswil, Switzerland

[21] Appl. No.: 09/093,670

[22] Filed: Jun. 8, 1998

[30] Foreign Application Priority Data

Dec. 5, 1997 [DE] Germany ..... 197 53 926

[51] Int. Cl.[7] ..... B63B 1/32

[52] U.S. Cl. ..... 114/285; 114/286; 440/89

[58] Field of Search ..... 114/285, 286, 114/287; 440/89; 181/235, 241, 243

[56] References Cited

U.S. PATENT DOCUMENTS

| | | | |
|---|---|---|---|
| 3,650,310 | 3/1972 | Childress | 114/286 |
| 3,738,301 | 6/1973 | Sjoo | 114/287 |
| 3,977,349 | 8/1976 | Hummel | 114/287 |
| 5,389,022 | 2/1995 | Kobayashi | 440/89 |
| 5,591,058 | 1/1997 | Schriever | 440/89 |
| 5,719,358 | 2/1998 | Lindholm | 181/235 |

FOREIGN PATENT DOCUMENTS 38 03 942 C2 8/1989 Germany .

*Primary Examiner*—Stephen Avila
*Attorney, Agent, or Firm*—Herbert Dubno

[57] ABSTRACT

A box-like trim tab for a high-speed motor boat or motor yacht has an inlet at its side pivotally connected with the stern of the boat so that it can allow the exhaust gas or a cooling liquid of the engine to pass through the trim tab and emerge at the open free side thereof. The trim tab reduces the noise generated by discharging the exhaust gas under the water or by conducting the exhaust gas through the water to the trim tab outlet.

13 Claims, 6 Drawing Sheets

TRIM TAB AND VARIABLE-EXHAUST SYSTEM ESPECIALLY FOR MOTOR BOATS AND MOTOR YACHTS

FIELD OF THE INVENTION

My present invention relates to a trim tab for motor boats and motor yachts and, more particularly, to a power boat provided with such a trim tab and wherein the trim tab is swingably mounted at the stern of the boat or yacht, e.g. on the transom thereof and can have a positioning unit connected between the stern and the trim tab for adjusting the angular positions thereof. The invention also relates to a variable exhaust outlet system for such motor craft which can control how the exhaust is discharged.

BACKGROUND OF THE INVENTION

Trim tabs are used on motor boats and motor yachts and are intended to compensate during high-speed travel of the boat or yacht, for the flow forces which act upon the hull. By angular adjustment of a trim tab swingably mounted at the stern, the tendency of water drag to impede forward motion can be reduced and the handling of the boat improved. Such tabs also improve the effectiveness of the propeller or screw at the stern of the boat.

While trim tabs are available in a variety of configurations, they as a rule are composed of metal plates which can be provided with one or more positioning mechanisms. Upper sides of the plates can be provided with reinforcing ribs or bends or flanges.

Rapidly traveling motor boats and motor yachts, for which the exhaust gas of one or more engines are normally discharged above the surface of the water, frequently travel in such manner that the exhaust gas can be released directly into the atmosphere at the stern. The result is a significant noise level associated with the release of the exhaust into the atmosphere. While a muffler may be provided for such engines, they muffler can require structural modification of the boat or yacht in an inconvenient manner. The same applies to other noise-damping devices.

Mention should also be made of the fact that other engine fluids such as engine-cooling water, may be released at the stern of the boat or yacht as well.

In the past, moreover, the location of the engine exhaust gas outlet in the craft has been found to be a complex task which has led to the need to compromise on various requirements arising in the operation of the boat or yacht. One such requirement is to optimize exhaust-gas routing to assure the best and hence least exhaust gas back pressure. Another requirement is the reduction of exhaust noise to the fullest extent possible. Still another requirement is avoidance of the return of exhaust fumes into the cockpit of the water craft.

OBJECTS OF THE INVENTION

It is the principal object of the present invention to provide a trim tab for a motor boat or motor yacht which obviates the aforedescribed drawbacks, i.e. can reduce the noise level generated, especially when the boat or yacht is traveling at high speed, because of the discharge of an engine fluid, especially the exhaust gases.

Another object of this invention is to provide a power boat in which an engine fluid is discharged at the stern of the boat, such that the sound level of the fluid discharge can be reduced.

Another object is to provide a power boat equipped with a trim tab and which can operate at reduced noise levels by comparison with other power boats.

It is also an object of this invention to provide an improved exhaust outlet system for boats and yachts which can obviate drawbacks of earlier exhaust routing arrangements for such watercraft.

More specifically, it is an object of this invention to provide a variable exhaust outlet system which can maximize engine power by reducing the back pressure of the engine exhaust, can reduce the emission of gas from the exhaust system into the environment and which will so control exhaust fumes as to direct them away from the operator and passengers of the boat or yacht.

SUMMARY OF THE INVENTION

These objects and others which will become apparent hereinafter are attained, in accordance with the invention by combining a trim tab with the engine exhaust in a single unit having the advantage of a single mounting for trimming and exhaust gas discharge, the benefit of variable gas outlet position, and the advantages of noise reduction, performance increase and fume control.

Since trim tabs during travel are usually at least partly immersed, the exhaust gas discharged through the trim tab is subjected to a high degree of sound damping. The sound damping can be still further improved when the free end of the passage, i.e. the end of the passage at the opposite side of the trim tab, is equipped with a flexible lip, e.g. of rubber, or with a swingable tab which is deflected by the exhaust gas flow and which can direct the sound toward the water. The known advantages of the trim tab with respect to controlling the trim of the vessel and improving the propulsion at the propellers or reducing the drag, are retained in the application of the trim tab according to the invention.

In a preferred embodiment of the invention, the trim tab is provided as a box-like hollow structural shape or profile formed with the passage which opens between one side juxtaposed with the stern of the boat or yacht and an opposite side parallel thereto and referred to as the free side. It has been found to be advantageous, further, to provide the trim tab with a planar upper side. Between the upper and lower sides of the hollow profile, at least one stiffening rib can be provided to extend in the direction of flow of the exhaust gas through the passage. The rib stiffens the trim tab against the forces applied by the water thereto and thus increases the stability of the hollow profile. The stiffening rib can be substantially perpendicular to the pivot axis about which the tab is swingable.

The trim tab of the invention has the important function, in addition to trimming the boat, of conducting the exhaust gas to a gas outlet which is more distal than the stern and which can lie beneath the water surface. While this may generate somewhat of a higher back pressure on the exhaust gas, it has been found to be advantageous to so mount the trim tab that the outlet lies below the water in normal trimming positions of the tab but can be swung out of the water if desired. When the trim tab is swung out of the water, of course, the back pressure on the exhaust gas is reduced and the engine or engines can operate at higher power.

The aesthetic appearance of the trim tab can be retained by forming the hollow profile such that it has a planar upper surface. The positioning mechanisms or surface which act upon the trim tab can be covered by a flexible covering arrangement. The flexible cover can bridge the stern of the hull and the upper side of the hollow profile.

More particularly, the power boat of the invention can comprise:

a hull having a stern;

an engine in or on the hull for propelling the boat and having means for discharging a fluid at the stern;

a trim tab swingably mounted on the hull at the stern and formed with a throughgoing passage communicating at one side of the trim tab with the means for discharging the fluid and opening at an opposite side of the trim tab; and positioning means on the hull at the stern operatively connected with the trim tab for adjusting the trim tab angularly relative to the hull.

According to another aspect of the invention, the marine engine exhaust gas is routed through an exhaust pipe which is swingably mounted at the aft of the craft and depending upon the operation of the craft, e.g. whether it is at rest, trolling, cruising or at high speed, that exhaust pipe is adjustable in its angular position relative to the water line to discharge the exhaust gas below or above the water line or parallel or along the water line.

In accordance with this aspect of the invention and as noted above, the exhaust pipe can have a rectangular or oval shape with a flattened bottom which enables it to be used as a trim tab. The trim tab or exhaust pipe through which the exhaust gas is discharged may have a muffler system incorporated therein to reduce moist emission, the muffler system being, for example, an arrangement of baffles.

The trim tab and exhaust gas outlet may be angularly adjusted by electric or hydraulic means which can be operated manually or by an electronic control unit automatically depending upon the operation of the vessel. For example, when the engine is started, the trim tab/exhaust pipe may have its outlet lifted above the water line to reduce exhaust back pressure and thus facilitate engine start-up. Immediately after engine start-up, the outlet may be lowered beneath the water line to reduce exhaust noise and to bury the exhaust fumes in the water. At trolling speeds it may again be advantageous to deflect the trim tab and exhaust outlet so that the latter is raised just to the water line to reduce back pressure at the engine and to enable the venturi effect to decrease back pressure and possibly trap the exhaust gases and pull them away from the vessel. At a cruising speed, when the hull is lifted partially into a planing, the exhaust gas outlet may again be lowered beneath the surface or into the trough behind the vessel to reduce exhaust noise emission. When high speeds are desired, it is advantageous to again raise the outlet above the water line to reduce back pressure and minimize engine power.

While in the preferred mode, the trim tab itself forms the exhaust outlet, it should be understood that, subject to the conditions described above and the ability to assume the various operating modes, the exhaust gas outlet may be provided in parallel to the trim tab.

The invention is also applicable to a motor boat utilizing an outboard motor, in which case the exhaust can be passed both through the trim tab or trim tabs and the lower drive unit of the outboard engine. Where the marine engine is of the inboard type, the exhaust gas can be routed through the stern drive and through the trim tabs.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
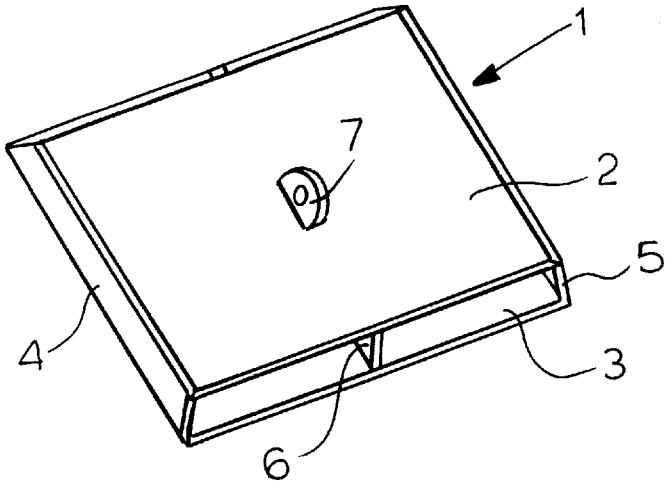
FIG. 1 is a diagrammatic perspective view of a trim tab for use in motor boats and motor yachts according to the invention.

The trim tab 1 shown in FIG. 1 is a box-like hollow profile with a planar upper side 2, an underside 3 substantially parallel thereto and side portions 4 and 5 which connect the upper side 2 of the lower side 3. The hollow profile has a substantially rectangular or trapezoidal cross section transverse to the direction of flow (arrow 20 in FIG. 4) of exhaust gas or other engine fluid therethrough.

On the upper surface an attachment lug 7 is provided to which a positioning mechanism 8 can be articulated. The positioning mechanism can include a servo-effector such as a hydraulic cylinder. It also may be the driven element of an electric motor servo-system.

Figure 4:
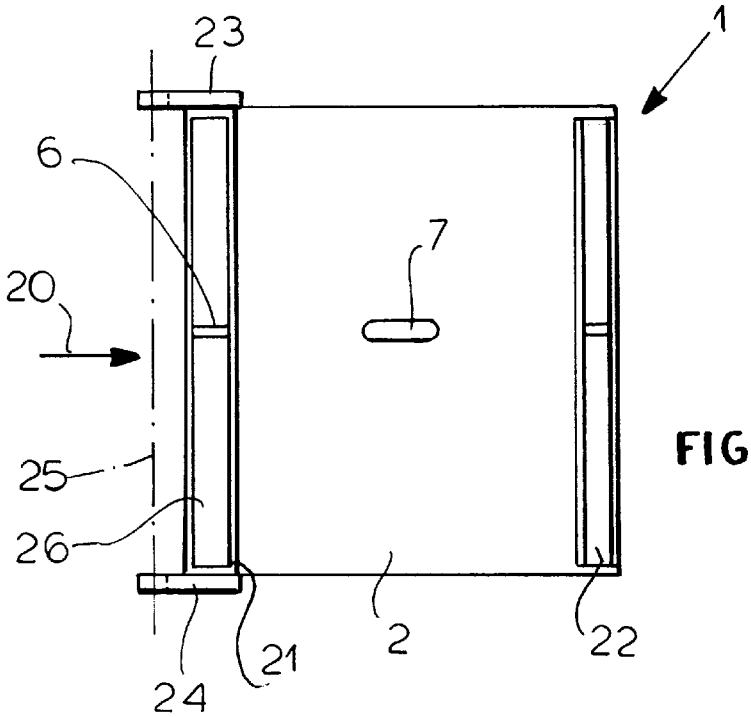
FIG. 4 is a plan view of the trim tab.

As will be apparent form FIG. 4, at opposite ends of the trim tab 1, an open side 21 and an open side 22 are provided so that the exhaust gas can pass in the direction of arrow 20 completely through the trim tab.

Plates 23 and 24 can be provided along the sides 4 and 5 of the trim tab so that a pivot rod 11 may be received therein to define the pivot axis 25 about which the trip tab can swing. This pivot axis is, of course, perpendicular to the passage 26 which receives the gas at its inlet side 21 and delivers the gas to the outlet side 22.

Figure 2:
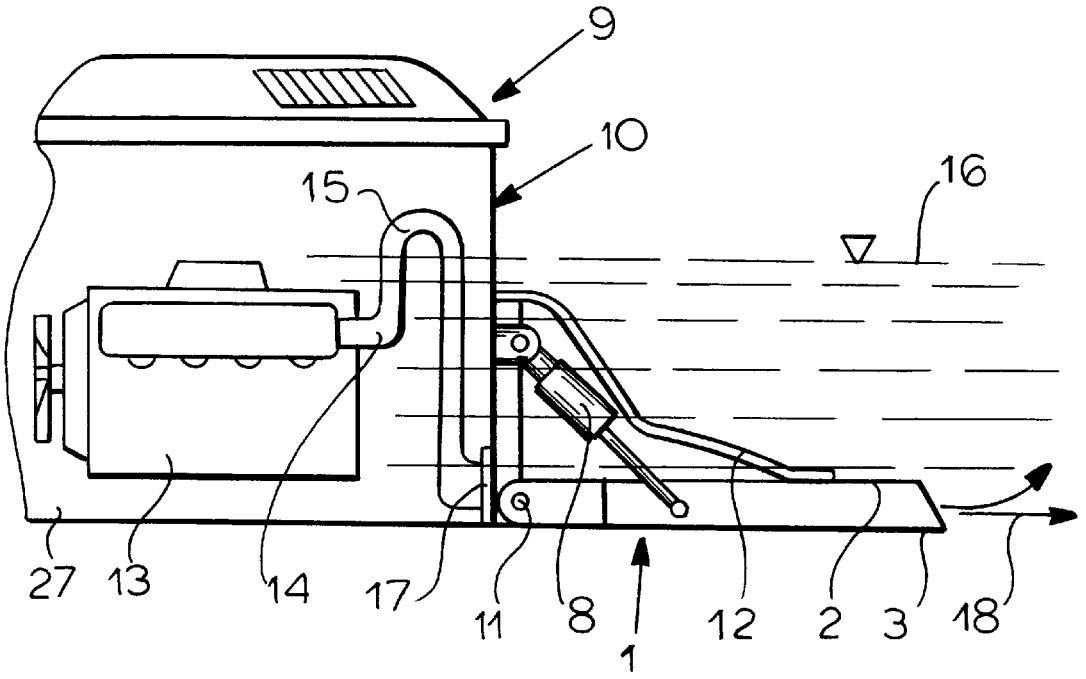
FIG. 2 is a diagrammatic side view of the stern of a power boat equipped with a trim tab.
Figure 3:
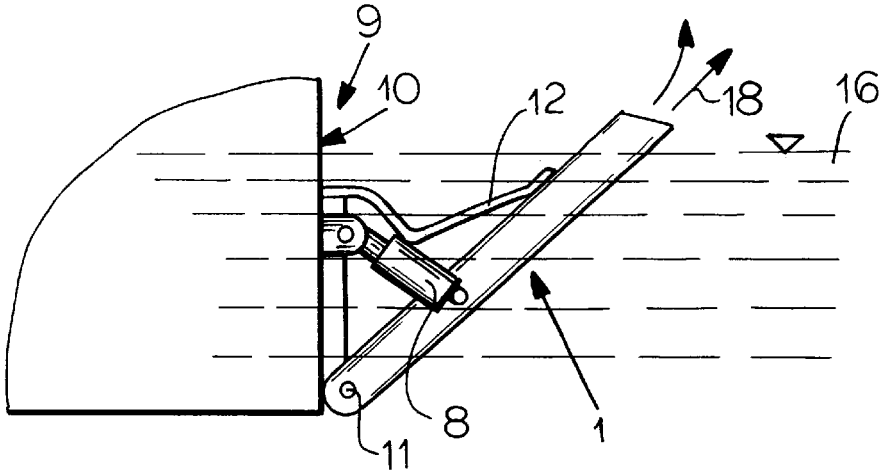
FIG. 3 is a view similar to FIG. 2 with the trim tab in another functional position.

Turning now to FIGS. 2 and 3, it will be apparent that the trim tab is mounted on a high-speed motor boat or motor yacht 9 whose stern or transom has been represented at 10. The trim tab 1 is mounted toward the bottom of this transom at the rear of the hull 27 by the pivot rod 11.

The positioning mechanism 8 can be, as shown, pivotally connected at one side to the hull of the boat in the region of the stern and pivotally connected at its other side to the lug 7. Between the planar upper side 2 and the stern 10, a flexible covering 12 can be provided for the positioning mechanism.

Within the hull 27 of the motor boat, one or more engines 13 are provided which can drive one or more propellers (not shown). From the engine or engines 13, exhaust gas lines 14 run to the stern. The exhaust gas line 14 can have a curve which lies above the water level 16 in the rest position of the boat, the exhaust pipe then extending downwardly to its outlet 17 at the bottom of the hull. The outlet 17 is aligned with the opening 21 at the hinged side of the trim tab 1. If desired, seals or the like can be provided between the opening 21 and the outlet 17.

The passage 26 is provided with a stiffening rib 6 bridging the upper and lower sides of the trim tab.

When the engine is operating, exhaust gas passes from the exhaust gas pipe 14 to the trim tab 1 which, as has been noted, is formed as a hollow profile. The exhaust gas emerges at the outlet 22. The gas flow has been represented by the arrows 18 in the drawing. Noise which would develop should the outlet 17 be exposed to the atmosphere at especially high speeds of the boat, are damped in the trip tab which normally discharges the gases into the water as shown in FIG. 2. The trim tab can be positioned to provide the requisite trim for the boat.

From FIG. 3 it will be apparent that the trim tab 1 can also be swung upwardly until its free side 22 is above the level 16 of the water. That reduces the counterpressure on the exhaust gas and trims the engine to operate at its maximum power.

Figure 5:
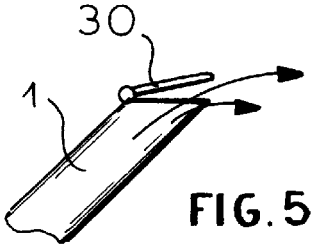
FIG. 5 is a detail showing the trim tab outlet in one embodiment.
Figure 6:
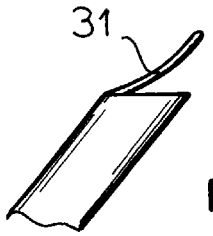
FIG. 6 is a view similar to FIG. 5 showing another embodiment of the trim tab outlet.

As can be seen from FIG. 5, a deflecting tab 30 can be provided at the discharge side of the trim tab 1 to deflect the emerging exhaust gas toward the water. Alternatively, a rubber lip 31 can be affixed along one edge of the open side 3 to deflect the outflowing exhaust gas laterally.

Figure 7:
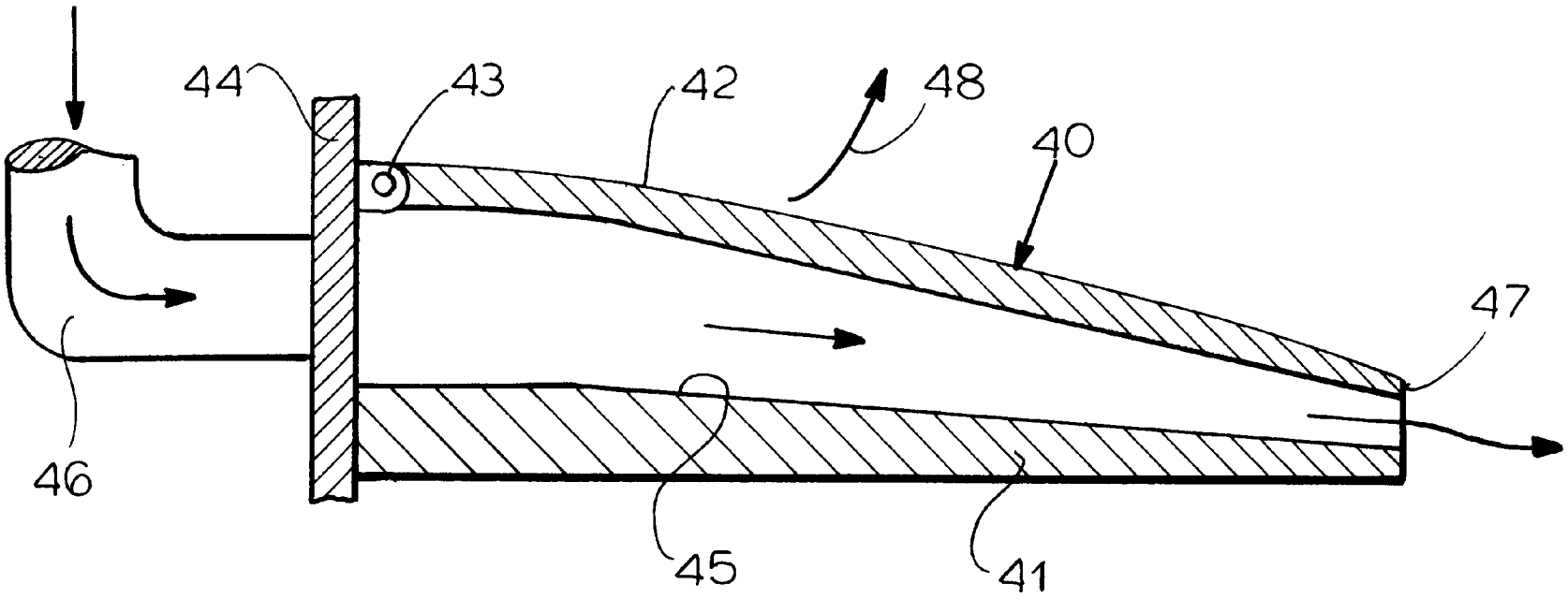
FIG. 7 is a cross sectional view of a swingable exhaust-gas outlet which can be used in parallel to the trim tabs or as a trim tab.
Figure 8:
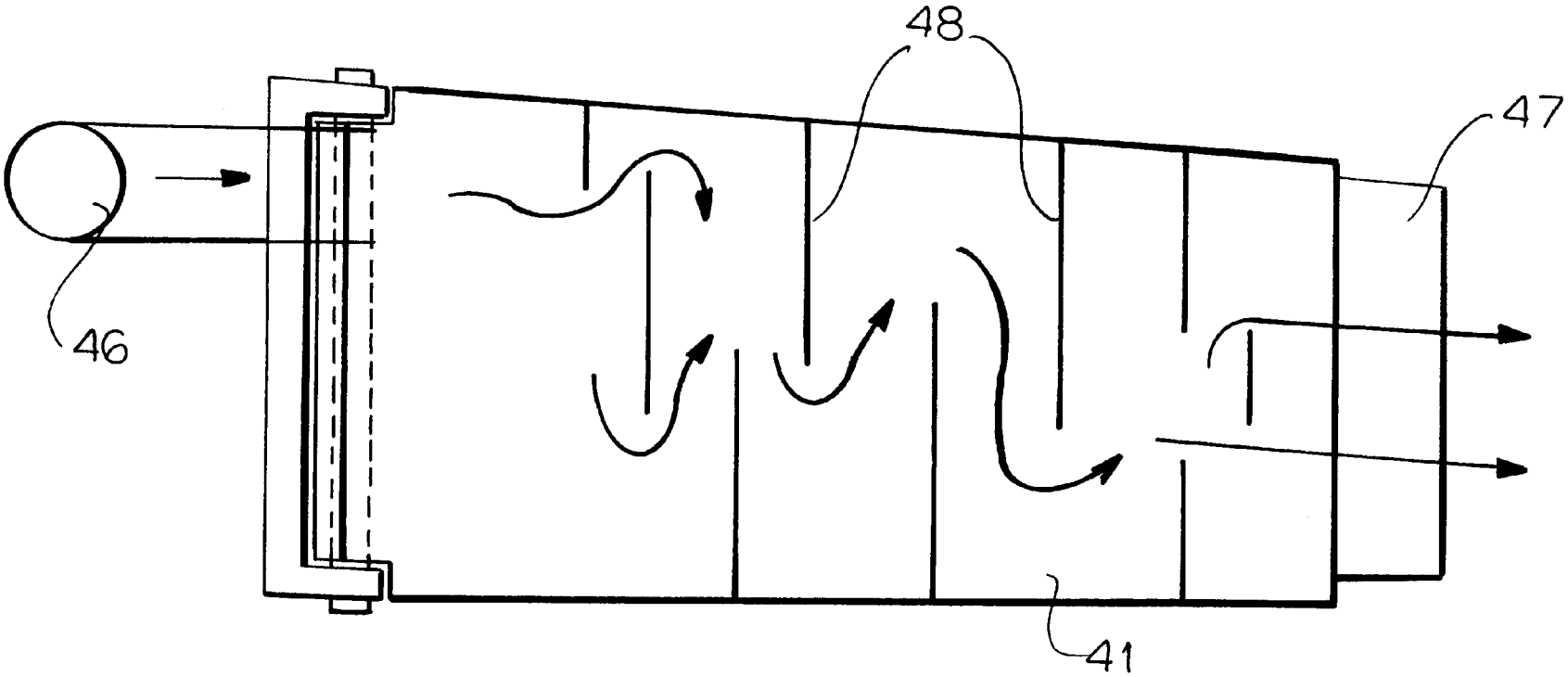
FIG. 8 is a diagram showing how baffles can be provided within this exhaust-gas outlet or trim tab so that it can simultaneously function as a muffler.

As can be seen from FIG. 7, an exhaust-gas outlet 40, which may be used as a trim tab and can have a flat bottom 41 and an upper side 42 converging toward the lower side, can be pivotally mounted at 43 at the stern 44 of the vessel and can have a chamber 45 communicating via a bellows or other flexible connection with the exhaust pipe 46 of the engine. In this embodiment, the chamber 45 has its outlet at 47 and is provided internally with baffles 48 as shown diagrammatically in FIG. 8 so that an indirect path is provided between the exhaust pipe 46 and the outlet 47. The sound emitted from the unit 40 is thus damped by the frequent redirection of the exhaust gas as it passes from the pipe 46 to the outlet 47.

Figure 9:
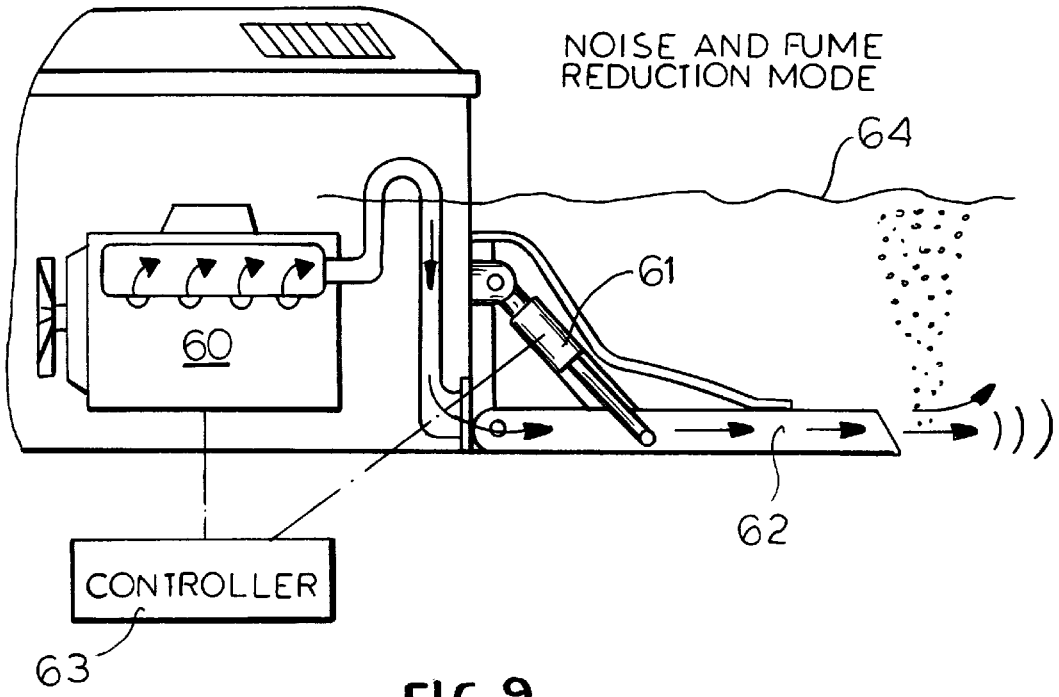
FIGS. 9, 10, 11 and 12 show the modes of operation of the trim tab or gas outlet which can be programmed into a control.

FIG. 9 shows that the engine 60 and the fluid cylinder 61 of a trim tab 62 or engine-exhaust outlet have a common controller 63 which may be of the programmable type and which, for normal engine speeds after start-up (FIG. 9) can discharge the exhaust gas below the water line 64 in the noise and fume reduction mode.

Figure 10:
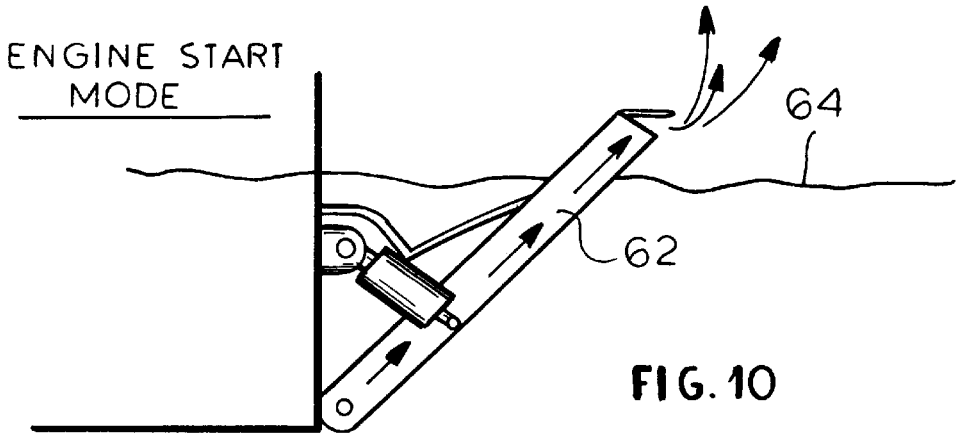
Figure 11:
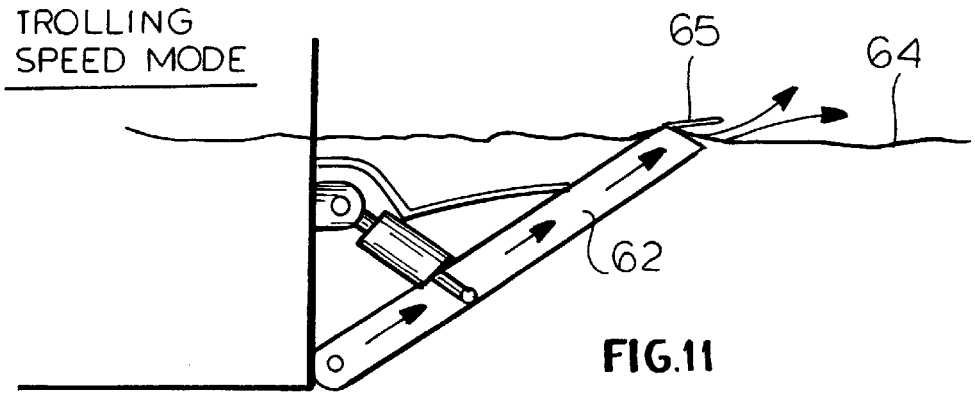
Figure 12:
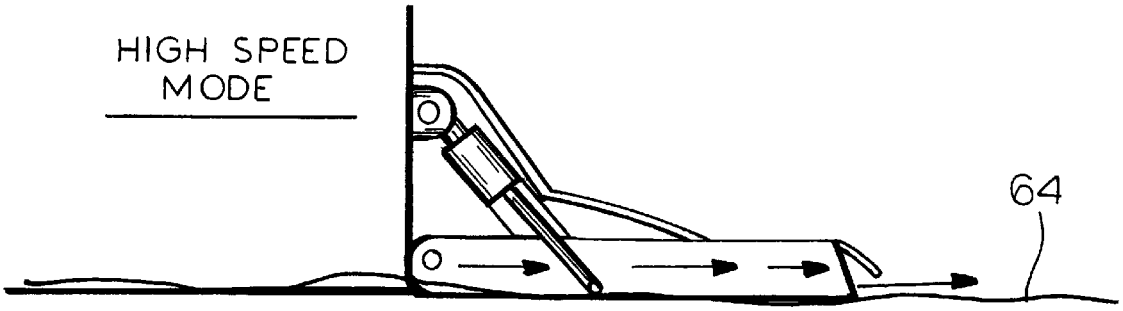

For engine start-up, however, the exhaust gas and fumes are discharged above the water line 64 (FIG. 10) while for trolling (FIG. 11), the outlet end 65 of the tab 62 can be disposed just at the water line 64. In the high-speed mode, when the vessel is planing, the tab or outlet is programmed to lie just at the water line (FIG. 12) as has been noted.

As has been noted previously, it is a feature of the invention that the exhaust gas from the marine engine can be routed both through the trim tab or trim tabs and through the stern drive. In the case of an inboard engine as shown in FIG. 2, for example, this means that a portion of the exhaust gas can be diverted from conduit 14 to pass through the stern drive (not shown).

Figure 13:
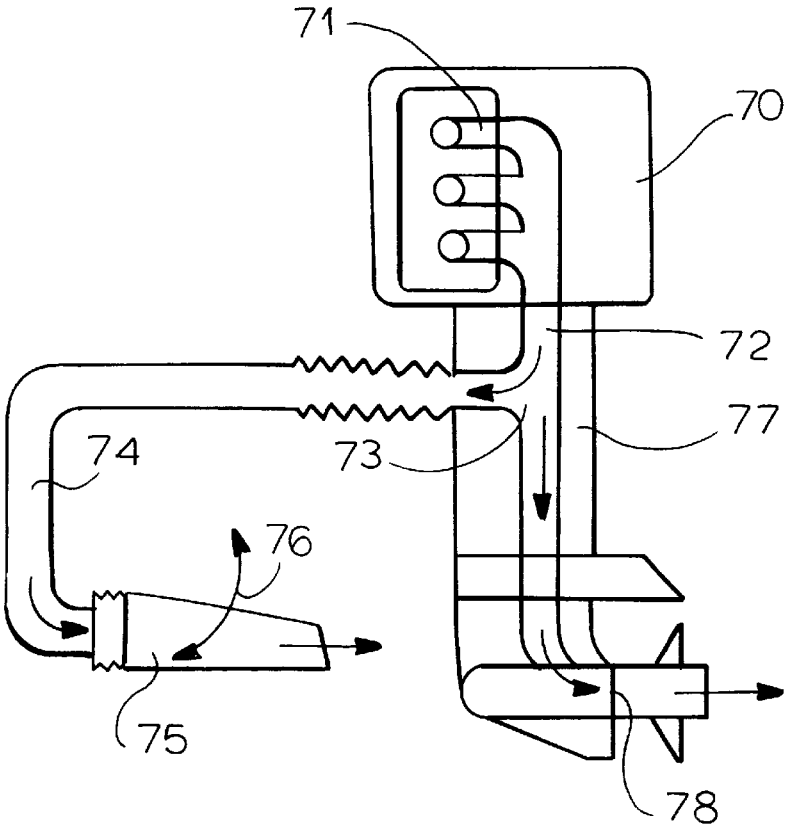
FIG. 13 is a diagram showing another embodiment.

Where, however, the marine engine is an outboard engine as has been shown at 70 in FIG. 13, the exhaust gas manifold 71 can have its exhaust gas pipe 72 branched at 73 so that a portion of the exhaust gas passes at 74 to the trim tab 75 which can be raised and lowered as represented by the arrow 76 while another portion passes at 77 to the lower drive unit 78 of the outboard to be discharged into the water at the propeller or screw of the outboard.

I claim:

1. A power boat comprising:

a hull having a stern;

an engine in said hull for propelling the boat and having means for discharging a fluid at said stern;

a trim tab swingable mounted on said hull at said stern and formed with a throughgoing passage communicating at one side of said trim tab with said means for discharging said fluid and opening at an opposite side of said trim tab; and positioning means on said hull at said stern operatively connected with said trim tab for adjusting said trim tab angularly relative to said hull, said trim tab being a box-shaped hollow body open at opposite free sides parallel to said stern, said passage connecting said free sides.

2. The power boat defined in claim wherein said box-shaped hollow body has upper and lower broad sides between said free sides and bounding said passage, at least said upper side being substantially planar.

3. The power boat defined in claim 2, further comprising at least one stiffening rib between said upper and lower sides.

4. The power boat defined in claim 3 wherein said trim tab is swingable about a pivot axis at said one side of said trim tab, said stiffening rib extending perpendicular to said pivot axis.

5. The power boat defined in claim 4 wherein said trim tab is swingable between a lower normal trim-tab position below a surface of water in which said boat travels and an upper position wherein said opposite side is above said surface of the water.

6. The power boat defined in claim 5, further comprising a flexible covering for said positioning means between said stern and said upper side of said trim tab.

7. The power boat defined in claim 6 wherein said opposite side of said trim tab is provided with a flexible lip.

8. The power boat defined in claim 6 wherein said opposite side of said trim tab is provided with a swingable closure tab.

9. An exhaust system for a power boat having a hull with a stern, an engine in said hull for propelling the boat, and an exhaust gas pipe coming from said engine, said system comprising an exhaust outlet swingably mounted on said stern, connected to said pipe and selectively discharging exhaust gas above, below or parallel to a water line.

10. The exhaust system defined in claim 9 wherein said exhaust-gas outlet is generally flat.

11. The exhaust system defined in claim 9 wherein said exhaust-gas outlet includes a muffler.

12. The exhaust system defined in claim 9 wherein said exhaust-gas outlet is formed in part by a trimtab and the exhaust gas pipe is branched from said engine to deliver a portion of exhaust gas product by said engine through sand trimtab and another portion to a stern drive driven by said engine.

13. The exhaust system defined in claim 12 wherein said engine is an outboard and said stern drive is a propeller unit at a lower part of said outboard.

* * * * *